US005093863A

United States Patent [19]

Galand et al.

[11] Patent Number: 5,093,863

[45] Date of Patent: Mar. 3, 1992

[54] FAST PITCH TRACKING PROCESS FOR LTP-BASED SPEECH CODERS

[75] Inventors: Claude Galand, Cagnes Sur Mer; Michele Rosso, Nice, both of France

[73] Assignee: International Business Machines Corporation, Armonk, N.Y.

[21] Appl. No.: 505,732

[22] Filed: Apr. 6, 1990

[30] Foreign Application Priority Data

Apr. 11, 1989 [EP] European Pat. Off. ..... 89480052.3

[51] Int. Cl.[5] ..... G10L 5/00

[52] U.S. Cl. ..... 381/38; 381/49

[58] Field of Search ..... 381/38, 49

[56] References Cited

U.S. PATENT DOCUMENTS 5,001,758 3/1991 Galand et al. ..... 381/36

5,012,517 4/1991 Wilson et al. ..... 381/36

*Primary Examiner*—Emanuel S. Kemeny

*Attorney, Agent, or Firm*—Joscelyn G. Cockburn

[57] ABSTRACT

A process for deriving voice pitch related delay values M to tune a Long-Term Prediction (LTP) filter to be used in an LTP based speech coder converting a speech derived digital signal r(n) into a lower bit rate signal, said filter being provided with a variable length delay line y(n) fed with a reconstructed signal r'(n). The process includes splitting r(n) into segments and each segment into sub-segments; then cross-correlating the first current r(n) sub-segment with a previously reconstructed segment and sorting the cross-correlation values for peak location, whereby a first delay value M1 is derived and used to tune the filter. Then, said M1 is used to compute sample indexes n for a predefined number of samples located about M1/p, . . . , M1, 2M1, . . . , pM1 and repeating cross-correlation and sorting operations to derive M2 and so on up to a full segment length (e.g. 160 samples). Then the process is started all over again.

8 Claims, 5 Drawing Sheets

SYNTHESIS

FAST PITCH TRACKING PROCESS FOR LTP-BASED SPEECH CODERS

FIELD OF THE INVENTION

This invention deals with a process for efficiently coding speech signal.

BACKGROUND OF INVENTION

Efficient coding of speech signal means not only getting a high quality digital encoding of the signal but in addition optimizing cost and coder complexity.

In some already known coders, the original speech signal is processed to derive therefrom a speech representative residual signal, compute a residual prediction signal using Long-Term Prediction (LTP) means adjusted with detected pitch related data used to tune a delay device, then combine both current and predicted residuals to generate a residual error signal, and finally code the latter at a low bit rate.

A significant improvement to the above cited type of coding scheme efficiency was provided, in copending European Application (EP 87430006.4), by detecting the pitch or an harmonic of said pitch (hereafter simply referred to as pitch, or pitch representative data, or pitch related data) using a dual-steps process including first a coarse pitch determination through zero-crossings and peak pickings, followed by a refining step based on cross-correlation operations performed about the detected pitched peaks.

While being particularly useful, the above cited pitch tracking process involves a rather high computing load as compared to the overall coder computing load.

For instance, using presently available signal processors, one had to devote 0.7 MIPS over 4 MIPS involved for an RPE/LTP coder just to pitch tracking operations.

SUMMARY OF INVENTION

The present invention provides a process for fast tracking of pitch related data to be used as a delay data in a Long Term Prediction-Based Speech Coder with minimal computing load. This is achieved by splitting the signal to be processed into N-samples long consecutive segments; splitting each segments into j sub-segments; cross-correlating the first current sub-segment samples with the previously decoded segment to derive therefrom a cross-correlation function and derive cross-correlation peak location index to be used as a first delay M1; setting M1 for the LTP coder loop; computing sample indexes about harmonics and sub-harmonics of said first delay; computing a new cross-correlation function over said indexed samples and deriving therefrom a new delay data M2; and so on up to last sub-segment; then repeating the process over next signal segment.

The foregoing and other objects, features and advantages of the invention will be made apparent from the following more particular description of a preferred embodiment of the invention as illustrated in the accompanying drawings.

DESCRIPTION OF A PREFERRED EMBODIMENT

Figure 1:
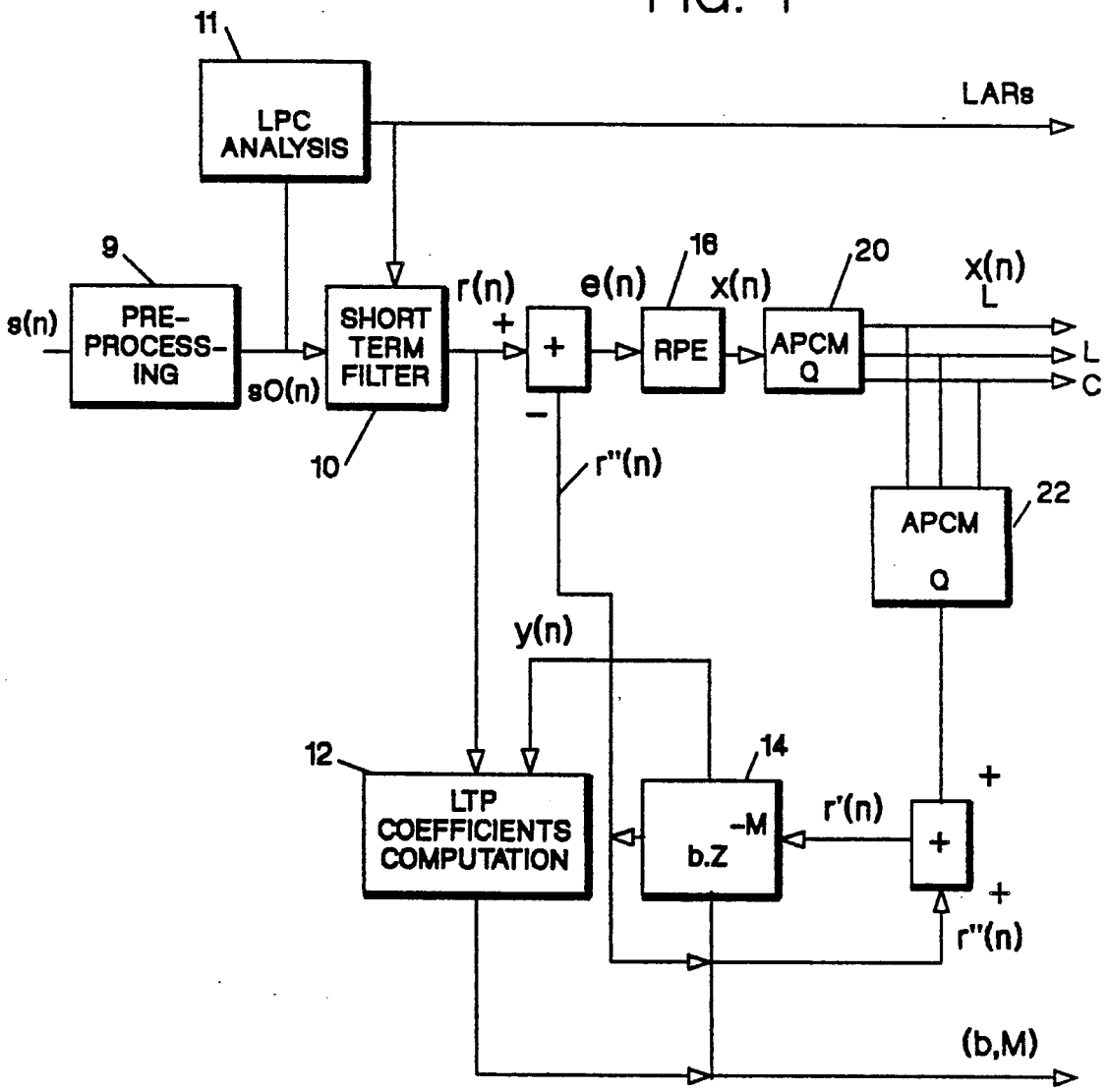
FIGS. 1 and 2 are representations of a speech coder wherein the invention is implemented.

Represented in FIG. 1 is a block diagram of a coder made to implement the invention. The original speech signal s(n) is first sampled at Nyquist frequency and PCM encoded with 12 bits per sample, in an A/D converter device (not shown). One may notice that such a coder (RPE/LTP) can achieve near toll quality speech coding compression at medium bit rates, but audible noise tones may be generated if the signal to be compressed presents a continuous component. This might be the case here, due to the use of the A/D convecter. In the RPE/LTP coder/decoder, high frequency components need being generated and this is achieved by base-band folding. As a consequence, if the speech signal contains a high level offset, the base-band signal will also contain this offset and any further reconstructed signal will present a pure tone at mirror frequencies. Offset tracking is implemented in device (9) through use of a notch high pass filter as defined by the GSM 06.10 of the CEPT (European Commission for Post and Telecommunication).

In summary, this filter made to remove the d-c component is made of a fixed coefficients recursive digital filter, the coefficients of which are defined by CEPT for the European radiotelephone.

A simpler alternate algorithm for the offset tracking can be implemented in the LTP loop i.e. over device 22 output as follows.

The d-c component of the decoded signal is removed from the residual error signal e'(n) to obtain a new signal e'(n) free of offset, by computing:

$$x_{of}(l) = x'_L(l) - \sum_{i=1}^{C} (x'_L(i))/C \quad \text{for } l = 1,C$$

where $x'_L(l)$ represents the decoded pulses amplitudes for RPE selected delay L and C the number of these pulses.

Then, the signal $x_{of}(n)$ is over sampled by interleaving zero-valued samples to generate the full-band signal e'(n) free of offset.

At the receiver, the same kind of operations are performed over the decoded base-band signal.

Turning back to the device of FIG. 1, the pre-processed signal provided by the device (9) is then fed into a short-term prediction filter (10).

The short-term filter is made of a lattice digital filter the tap coefficients of which are dynamically derived (in device (11)) from the signal through LPC analysis. To that end, the pre-processed signal is divided into 160 samples long no overlapping segments, each representing 20 ms of signal. A LPC analysis is performed for each segment by computing eight reflection coefficients using the Schur recursion algorithm. For further details on the Schur algorithm, one may refer to GSM 06.10 specification hereabove referenced.

The reflection coefficients are then converted into log area ratio (LAR) coefficients, which are piecewise linearly quantizied with 32 bits (6, 5, 5, 4, 3, 3, 3, 3) and coded for being used during s(n) re-synthesis.

The eight coefficients of the short-term analysis filter are processed as follows. First the quantized and coded LAR coefficients are decoded. Then, the most recent and the previous set of LAR coefficients are interpolated linearly within a 5 ms long transistion period to avoid spurious transients. Finally, the interpolated LARs are reconverted into the reflection coefficients of the lattice filter. This filter generates 160 samples of a speech derived (or residual) signal r(n) showing a relatively flat frequency spectrum, with some redundancy at a pitch related frequency.

A device (12) processes the residual signal to derive therefrom a pitch, or harmonic, representative data, in other words, a pitch related information M and a gain parameter b to be used to adjust a long term prediction filter (14) performing the operations in the z domain as shown by the following equation:

$$R''(z)=b.z^{-M}R'(z) \quad (1)$$

Wherein R'(z) and R''(z) are z-domain transforms of time-domain signals r'(n) and r''(n) respectively.

The device for performing the operation of equation (1) should thus essentially include a delay line whose length should be dynamically adjusted to M (pitch or harmonic related delay data) and a gain device. (A more specific device will be described further).

Efficiently measuring b and M is of prime interest for the coder since a prediction residual signal output r''(n) of the long term predictor filter (tuned with M) needs be subtracted from the residual signal to derive a long term decorrelated prediction error signal e(n), which e(n) is then to be coded into sequences of pulses x(n) using a Regular Pulse Excitation (RPE) method. In other words, a RPE device (16) is used to convert for instance each sub-segment of consecutive PCM encoded e(n) samples into a smaller number, say less than 15, of most significant pulses subsequently quantized using an APCM quantizer (20). These considerations help appreciate the importance of a precise adjustment of filter (14) thus of a good evaluation of b and M.

Briefly stated, when using RPE techniques, each sub-group of 40 e(n) samples is split into interleaved sequences. For instance two 13 samples and one 14 samples long interleaved sequences. The RPE device (16), is then made to select the one sequence among the three interleaved sequences providing the least mean squared error when compared to the original sequence. Identifying the selected sequence with two bits (L) helps properly phasing the data sequence $x_L(n)$.

For further information on the RPE coding operation, one may refer to the article "Regular Pulse Excitation, a Novel Approach to Effective and Efficient Multipulse Coding a Speech" published by P. Kroon et al. in IEEE Transactions and Acoustics Speech and Signal Processing Vol ASSP 34 No. 5 Oct. 1986.

The long term prediction associated with regular pulse excitation enables optimizing the overall bit rate versus quality parameter, more particularly when feeding the long term prediction filter (14) with a pulse train r'(n) as close as possible to r(n), i.e. wherein the coding noise and quantizing noise provided by device (16) and quantizer (20) have been compensated for. For that purpose, decoding operations are performed in device (22) the output of which e'(n) is added to the predicted residual r''(n) to provide a reconstructed residual r'(n). Also, the closed loop structure around the RPE coder is made operable in real time by setting minimal limit to the pitch related data detection window.

Figure 2:
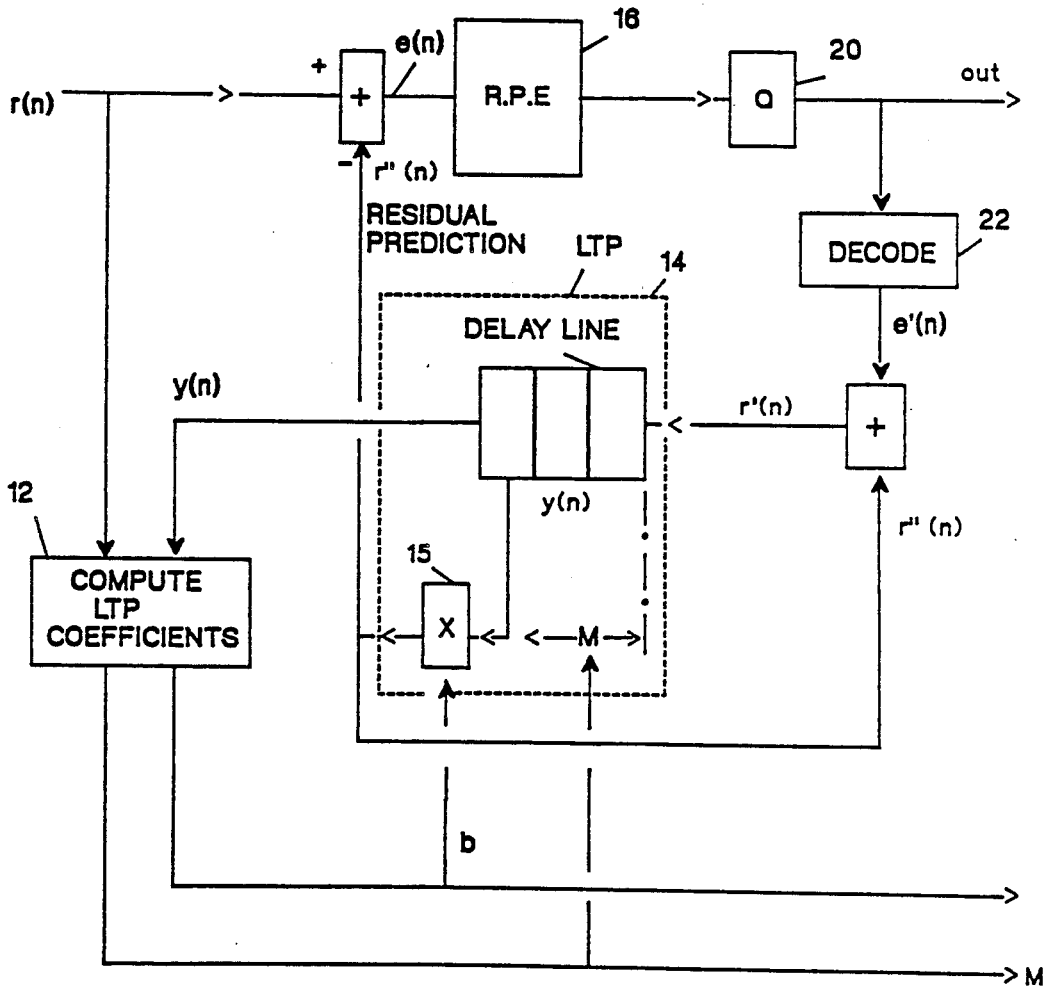

An implementation of Long Term Prediction filter (14) of FIG. 1 is represented in FIG. 2. The reconstructed residual signal is fed into a 120 y samples (maximal value for M is 120) long delay line (or shift register) the output of which is fed into the LTP coefficients computing means (12) for further processing to derive b and M coefficients. A tap on the delay line is adjusted to the previously computed M value. A gain factor b is applied to the data available on said tap, before the result being subtracted from r(n) as a residual prediction r''(n) to generate e(n).

The long term predicted residual signal is thus subtracted from the residual signal to derive the error signal e(n) to be coded through the Regular Pulse Excitation device (16) before being quantized in quantizer (20).

A significant advantage of this coder architecture derives from the fact that M should be a delay representative of either s(n) pitch or a pitch harmonic, as long as it is precisely measured in the device (12).

To that end, the delay M is computed each 5 ms (40 samples). The signal r(n) is split into consecutive segments 160 samples long, each segment being subdivided into j (e.g. j=4) sub-segments.

The first sub-segment of r(n) samples and the previously reconstructed excitation segment y(n) are cross-correlated as follows $$R(n) = \sum_{i=0}^{39} r(i) \cdot y(i-n) \quad (2)$$

for n=40, . . . , 120.

The computed R(n) values are sorted for peak location to derive the first optimal delay value M1 through:

$$R(M1)=Max(R(n));(n=40,120) \quad (3)$$

The corresponding gain value b1 is derived from:

$$b1 = R(M1)/\sum_{i=0}^{39} y^2(i-M1) \quad (4)$$

The LTP filter is tuned with b1 and M1 and the signal is shifted over one sub-segment (i.e. 40 samples).

For the next sub-segments, the pitch related delay value is evaluated as follows:

First M1 multiples and sub-multiples are computed to derive M1, 2M1, 3M1, . . . , pM1, $M\frac{1}{2}$, $M\frac{1}{3}$, . . . , M1/p, wherein p is a predefined integer value, e.g. p=3. Then k sample indexes n are defined wherein k is a predefined integer, say k=5.

n=(M1−k), (M1−k−1), . . . , (M1), . . . , (M1+k−1), (M1+k).

n=(2M1−k), (2M1−k−1), . . . , (2M1), . . . , (2M1+k−1), (2M1+k).

. . .

. . .

n=(pM1−k), (pM1−k−1), . . . , (pM1), . . . , (pM1+k−1), (pM1+k).

n=((M½)−k), ((M½)−k−1), . . . , (M½), . . . , ((M½)+k−1), ((M½)+k).

n=((M⅓)−k), ((M⅓)−k−1), . . . , (M⅓), . . . , ((M⅓)+k−1), ((M⅓)+k).

. . .

. . .

n=((M1/p)−k), ((M1/p)−k−1), . . . , (M1/p), . . . , ((M1/p)+k−1), ((M1/p)+k).

With the constraint 39<n<121.

In other words, the above computed n values are sample indexes for samples located about the pitch related values selected to be M1 multiples and sub-multiples.

The cross-correlation function (2) is then computed for the above defined indexed samples, and the so-computed R(n) values are again sorted for peak location, whereby a new optimal delay M2 for the second sub-segment is derived.

The same algorithm is repeated with M2 replacing M1 and next delay M3 is computed, and so on up to Mj, which brings up to last current sub-segment. The overall process may then be repeated over next samples segment.

For each M value, a corresponding gain b is computed based on equation (4). These LTP parameters may be encoded with 2 and 7 bits respectively.

Figure 3A:
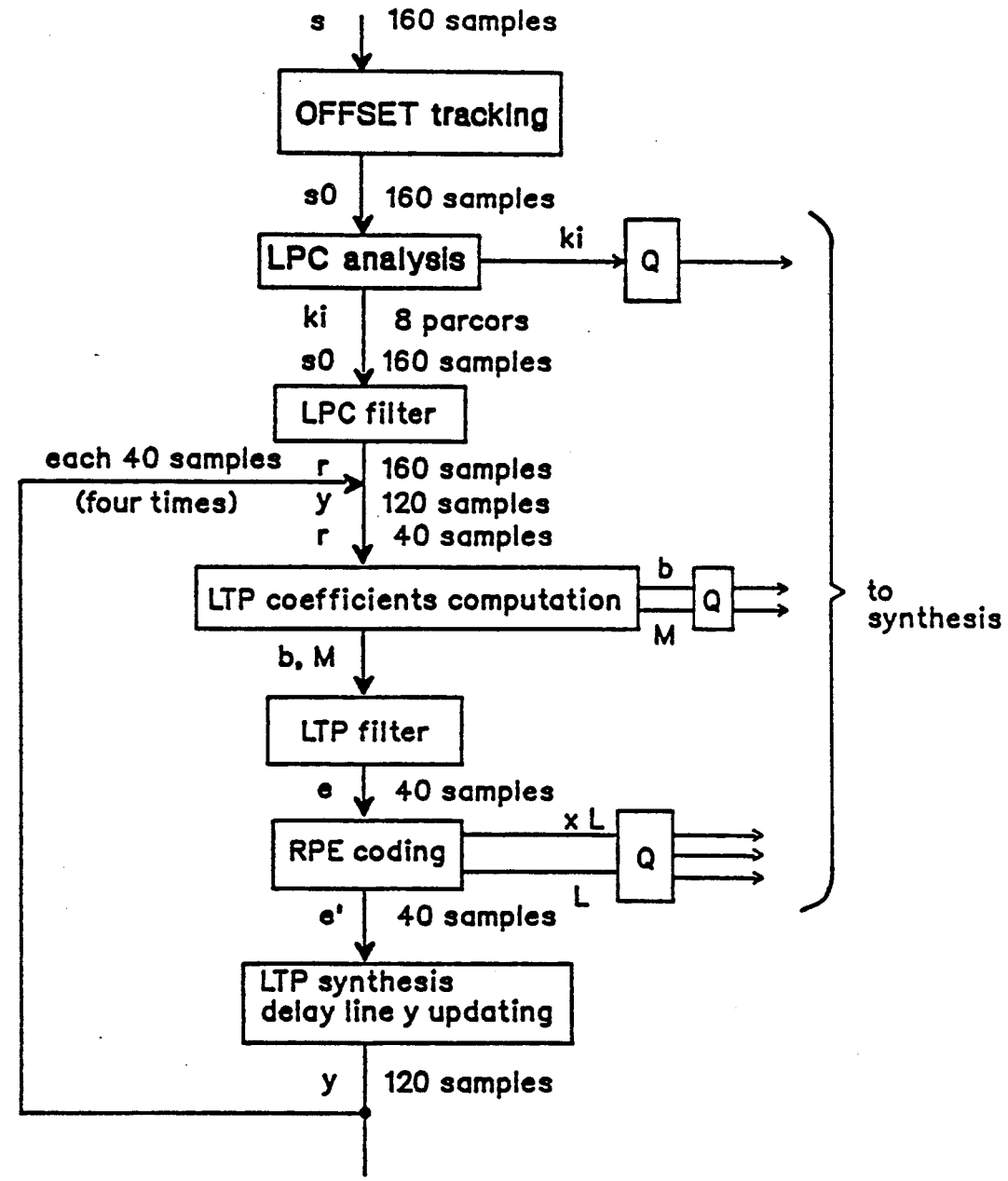
FIGS. 3A, B and 4 are flowcharts for algorithmic representations of the invention process.
Figure 3B:
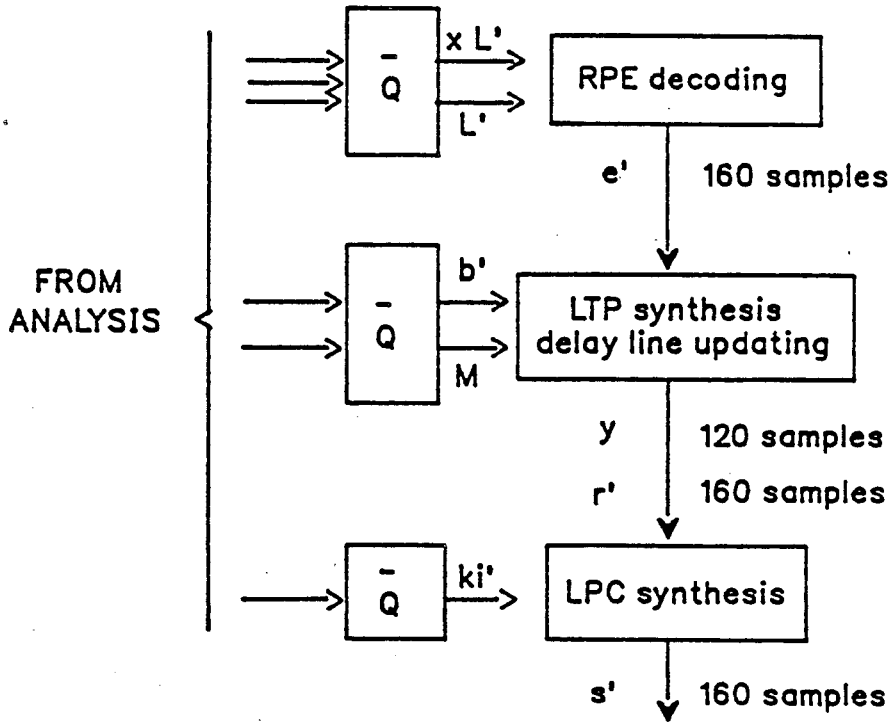
Figure 4:
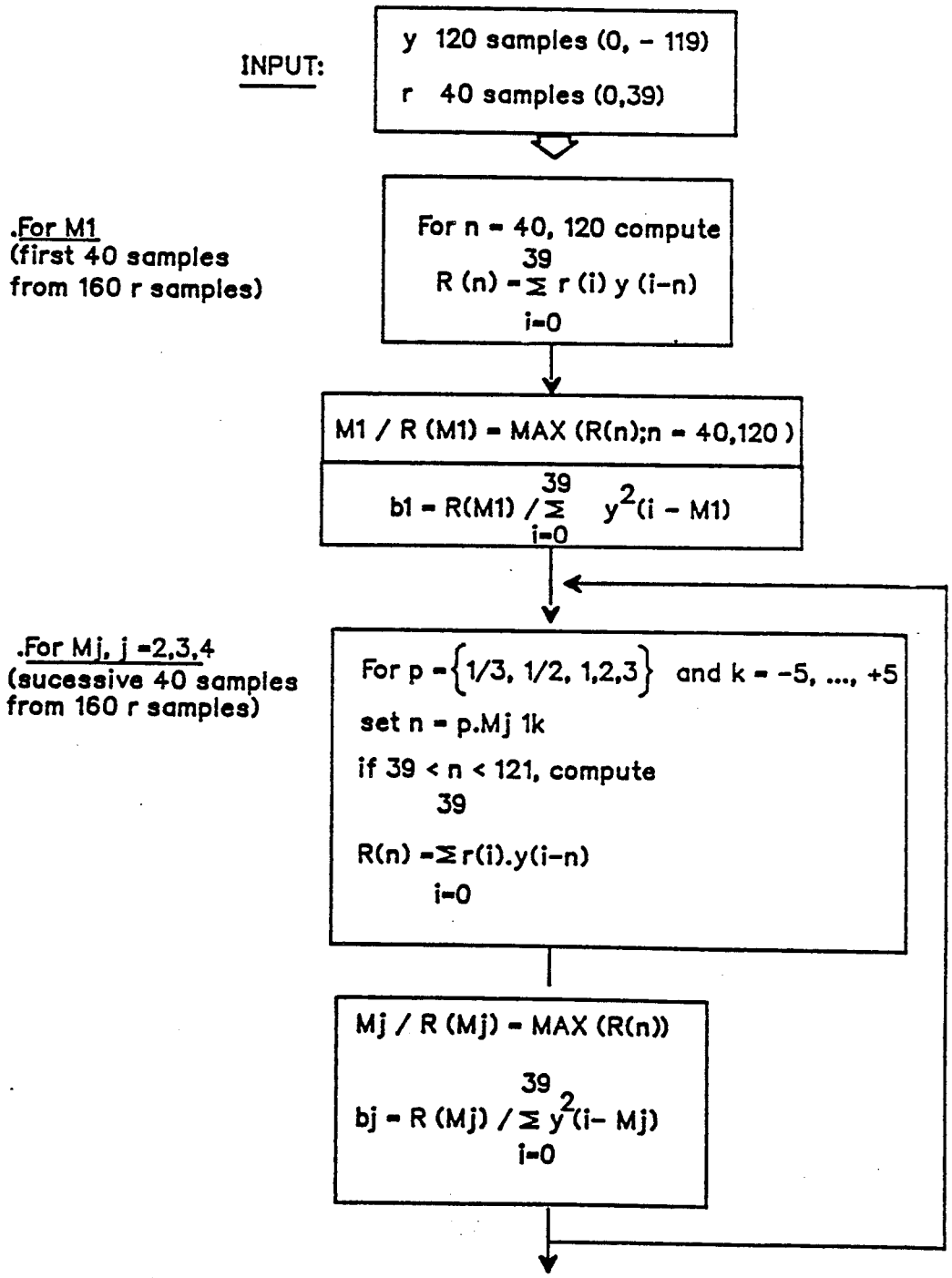

Represented in FIGS. 3 and 4 are algorithmic representations of the fast pitch tracking process which may then easily be converted into programs made to run on a microprocessor. The example was made to process segments 160 samples long subdivided into j=4 sub-segments. For speech coding analysis, the s(n) flow is split into 160 samples long segments, first submitted to offset tracking processing and generating 160 "$s_O$" samples. The "$s_O$" samples are, in turn, submitted to LPC analysis generating eight PARCOR coefficients ki quantized into the LARs data.

The PARCORS ki are used to tune an LPC short-term filter made to process the 160 samples "$s_O$" to derive the residual signal r(n). Said r(n) samples segment is split into forty samples long sub-segments, each to be processed for LTP coefficients computation with previously derived y segments 120 samples long. The LTP coefficients computation provides b and M quantized for sub-segment transmission (or synthesis). These b and M data once dequantized or directly selected prior to quantization are used to tune the LTP filter. Then, subtracting said LTP filter output from r(n) provides e(n).

Forty consecutive e(n) samples are RPE coded into a lower set of $x_L$ samples and a set reference L, each being quantized. Then dequantized over sampled sub-segment of samples (e'(n)) are used for LTP synthesis and delay line updating up to full segment by repeating the operations starting from LTP coefficients computation.

Correlative speech synthesis (i.e. decoding) involves the following operations:

RPE decoding, using dequantized $x_L$ and L parameters to generate 160 e' samples;

LTP synthesis and delay line updating, using dequantized LTP filter parameters and deriving 160 reconstructed residual samples r'.

LPC synthesis over the synthesized residual signal samples and generation of a synthesized speech signal s'.

More particularly emphasized are the LTP coefficients computation steps (see FIG. 4). First input samples buffered for computing M1 are 120 samples (referenced 0,119) of current y signal and 40 samples r (referenced 0,39). These samples are cross-correlated according to equation 2. The R(n) values are then sorted according to equation 3 to derive M1 which is used to compute b1 according to equation 4, set the LTP filter accordingly and shift the signals one sub-segment (i.e. 40 samples).

Then M2 is computed by setting samples indexes according to the following equation:

$$n=p.M_{j-1}+k \qquad (5)$$

for $p=\{\frac{1}{3}, \frac{1}{2}, 1, 2, 3\}$ and $k=-5, -4, \ldots, +5$ and $39<n<121$.

In other word, setting sample indexes n for samples located about harmonic and sub-harmonics of said pitch related data M. Then compute.

$$R(n) = \sum_{i=0}^{39} r(i) \cdot y(i-n)$$

and go back to R(n) sorting to derive M2 and b2.

Finally the process starting with equation (5) is repeated to derive M3 and b3, and, M4 and b4.

Although the process of this invention was described with reference to a specific coder embodiment wherein lower rate is achieved through use of RPE techniques, it surely applies as well to other low rate coding schemes such as, for instance, Multipulse Excitation (MPE) or Code Excited Linear Predictive coding (CELP).

Also, r(n) could either be a full band residual or be a base-band residual, as well and the invention be implemented without departing from its original scope.

We claim:

1. A process for deriving voice pitch related delay values M to tune a Long-Term Prediction (LTP) filter to be used in an LTP-based speech coder converting a speech derived digital signal r(n) into a lower bit rate signal, said filter being provided with a variable length delay line fed with a reconstructed signal r'(n), and said process including:

a) splitting said r(n) signal into N samples long consecutive segments;

b) splitting each segment into j sub-segments, j being a preselected integer;

c) cross-correlating the first current signal sub-segment with a previously reconstructed signal segment to derive therefrom a cross-correlation function R(n), wherein:

$$R(n) = \sum_{i=0}^{k'-1} r(i) \cdot y(i-n); \text{ with } k' = N/j$$

for n=k' to N d) sorting the R(n) values for peak location R(M1), setting the filter delay to M1 and shifting the signals samples over one sub-segment;

e) computing sample indexes n for a predefined number of samples located about M1 harmonics and sub-harmonics, i.e. located about M1/p, . . . , M1/3, M1/2, M1, 2M1, 3M1, . . . , pM1 wherein p is a predefined integer value and n=pM1+k where k is a predefined integer value;

f) computing the cross-correlation function values R(n) for n defined in step (e);

g) sorting the R(n) values for peak location to derive a new delay value M2;

h) repeating steps (e) through (g) using M2 instead of M1, and so on up to Mj.

2. A process according to claim 1 wherein said filter transfer function in the z-domain is of the form $b.z^{-M}$ with b deriving from M according to:

$$b = R(M) / \sum_{i=0}^{k'-1} y^2(i-M)$$

wherein k'=N/j

3. A process according to claim 1 or 2 wherein said speech derived digital signal is a speech residual signal.

4. A process according to claim 2 wherein said speech derived digital signal is a base-band residual signal.

5. A process according to claim 4 wherein said residual signal is derived from a speech signal preprocessed through offset tracking.

6. A process according to claim 5 wherein said low bit rate signal is achieved through use of RPE techniques.

7. A process according to claim 5 wherein said low bit rate signal is achieved through use of MPE techniques.

8. A process according to claim 5 wherein said low bit rate signal is achieved through use of CELP techniques.

* * * * *